United States Patent [19]

Almgren et al.

[11] 4,424,430

[45] Jan. 3, 1984

[54] ENERGY FEED SYSTEM FOR A MICROWAVE OVEN

[75] Inventors: Per H. I. Almgren; Ove R. Fredriksson; Adil M. Nasretdin, all of Norrköping, Sweden

[73] Assignee: U.S. Philips Corporation, New York, N.Y.

[21] Appl. No.: 309,335

[22] Filed: Oct. 7, 1981

[30] Foreign Application Priority Data

Oct. 7, 1980 [SE] Sweden ..... 8006994

[51] Int. Cl.[3] ..... H05B 6/72

[52] U.S. Cl. ..... 219/10.55 F; 219/10.55 R

[58] Field of Search ..... 219/10.55 F, 10.55 A, 219/10.55 R

[56] References Cited

U.S. PATENT DOCUMENTS

| | | | |
|---|---|---|---|
| 4,314,127 | 2/1982 | Weiss | 219/10.55 F |
| 4,327,266 | 4/1982 | Austin et al. | 219/10.55 F |
| 4,342,896 | 8/1982 | Teich | 219/10.55 F |
| 4,343,976 | 8/1982 | Nasretdin et al. | 219/10.55 F |
| 4,350,859 | 9/1982 | Dudley et al. | 219/10.55 F |

*Primary Examiner*—B. A. Reynolds
*Assistant Examiner*—Philip H. Leung
*Attorney, Agent, or Firm*—Robert T. Mayer; Bernard Franzblau

[57] ABSTRACT

An energy feed system for microwave ovens includes a rotatable slotted disc (24) arranged within the oven cavity (10) in front of a feeding aperture (22) in a cavity wall (11). The disc is essentially larger than the feeding aperture and is arranged at a small distance from the cavity wall (11) so that a narrow space (42') is formed between this wall (11) and the disc, through which microwave energy can propagate radially outwardly. The disc comprises a number of slots (27–29, 46–51), oriented transversely to their respective radial position vectors and dimensioned so as to serve as antenna elements for radiating energy into the interior of the oven cavity (10). The disc is journalled eccentrically so as to perform simultaneously a rotational and a translational motion and the narrow space between the disc and the cavity wall is also utilized for guiding an air stream to impinge on vanes (30–32, 44, 45) secured to the lower side of the disc so as to cause the disc to rotate in a predetermined direction.

15 Claims, 6 Drawing Figures

ENERGY FEED SYSTEM FOR A MICROWAVE OVEN

The present invention relates to a microwave oven comprising an oven cavity limited by a plurality of conductive walls, a microwave energy source, and an energy feed system for coupling energy from the microwave energy source to the interior of the oven cavity comprising a feeding aperture in a cavity wall and a rotatable slotted disc arranged within the oven cavity in front of the feeding aperture for producing a relatively even energy distribution within the oven cavity.

A microwave oven of this type is well known and is shown, for example, in FIG. 7 of U.S. Pat. No. 2,920,174. In this microwave oven the rotatable slotted disc is located at a relatively large distance from the feeding aperture and the resonant slots are arranged in the disc so that they appear sequentially in front of the feeding aperture as the disc is rotated. The longitudinal axes of the slots are in a non-radial and non-parallel alignment and whenever a resonant slot is in front of the feeding aperture a part of the energy from the microwave source is coupled to the oven cavity through this slot. A disadvantage of this arrangement is that it provides only a small improvement in the energy distribution within the oven cavity because only a small part of the energy from the microwave source is coupled through the resonant slots to vary the energy distribution within the oven cavity.

FIG. 6 of this U.S. Pat. No. 2,920,174 shows another widely used arrangement for improving the energy distribution in a microwave oven cavity. In this microwave oven, the energy distribution within the oven cavity is varied by means of a "mode stirrer" of the fan-type comprising two sets of vanes of conductive material having different inclinations with respect to the plane of rotation and appearing sequentially in front of the feeding aperture. In this case the improvement of the energy distribution within the oven cavity is the result of a periodic variation of both the resonance conditions of the cavity and the directions of energy reflection by the blades. The disadvantages of this arrangement include strongly varying operational conditions for the microwave source, usually a magnetron.

An approach to solve this latter problem is found in U.S. Pat. No. 3,939,320 in which the energy feed system includes a resonant coupling structure disposed near the feeding aperture of the oven cavity and acting as a matching transformer to provide good matching with the microwave source. This resonant structure is in the shape of a short hollow cylinder of conductive material which rotates eccentrically to spread an energy beam in many directions. The dimensions of this resonant structure are smaller than those of the feeding aperture and the movements of the eccentrically rotating structure are substantially confined to the area of the feeding aperture. However, this approach to creating an even energy distribution within the oven cavity only works to a small extent because only one single movable coupling element is used through which only a part of the energy passes from the microwave source into the oven cavity.

Another approach to smoothing the energy distribution within a microwave oven cavity is found in U.S. Pat. No. 4,185,181 which utilizes a rotatable antenna element radiating polarized waves. The antenna element is secured to one end of a rotating conductive arm, which also serves as a transmission line for feeding microwave energy to the antenna element. This system for guiding microwave energy is, however, rather complicated.

The movable elements of the energy feed systems are most frequently driven by separate motors, compare each of the documents cited in the foregoing. However, the use of an air stream to drive the movable elements has also been suggested, e.g. see U.S. Pat. No. 3,471,671 in which an air stream is directed into the oven cavity to impinge on vanes mounted about the periphery of a rotatable disc. While such an air drive can represent a more economical arrangement than a separate motor drive, the air drive has been used less widely because of problems in controlling the rotation and arriving at the proper balance between the relative positions of the movable elements and the air source on the one hand and the proper speed of rotation on the other hand, whereby the air drive mechanism is still rather complicated.

A microwave oven comprising a rotating air driven slotted antenna element is described in U.S. Pat. No. 4,350,859. The rotating antenna element consists of a dish connected to a flat top plate provided with three energy radiating slots. Microwave energy is fed into said dish at the center thereof and the dish together with the flat top plate define a closed compartment shaped so as to form three separate wave guides from the central feeding point to the three antenna slots in the plate. This feed structure forms a directional antenna that operates according to the near field power theory, i.e. that the microwave energy is radiated into the oven cavity at a limited central area of the oven where the food is normally placed, whereby the energy will be absorbed directly by the food without first being reflected by the cavity walls. In the aforesaid feed structure the three antenna slots are situated at different distances from the center of the dish but, relative to the dimensions of the cavity, the said distances are so small that all three slots can be regarded as situated substantially at the center of the bottom wall of the cavity. The rotation of the antenna element including the dish and the flat top plate is effected by means of an air stream that is also used to cool the magnetron.

It is an object of the present invention to provide a microwave oven comprising an energy feed system of the type set forth in the preamble which is simple and inexpensive, but nevertheless gives an improved smoothing of the energy distribution within the oven cavity as compared with conventional systems and in which the rotatable disc can be driven in a simple manner by an air stream derived from the cooling air for cooling electrical components without using separate drive motors or complicated drive mechanisms.

According to the invention this is accomplished in a microwave oven of the type set forth in the preamble by the combination of the following measures:

- the disc is essentially larger than the feeding aperture and is arranged at a small distance from the cavity wall containing the feeding aperture so that a narrow space is formed between this cavity wall and the disc, which narrow space serves to propagate microwave energy from the feeding aperture to the interior of the oven cavity;
- the disc comprises a plurality of slots which are oriented transversally to their respective radial position vectors and are dimensioned so as to be excited by microwave energy propagating in said narrow space to radiate energy into the interior of the oven cavity;

the disc is journalled eccentrically so that both the disc and the slots perform simultaneously a rotation and a translation as the disc is rotated; and means may be provided for passing an air stream through said narrow space to impinge on projections of the disc so as to cause the disc to rotate in a predetermined direction.

This energy feed system operates according to a new principle which is quite different from the prior art feed systems. It functions so that a part of the energy propagating in all directions in the narrow space is coupled into the cavity through the slots, while the remaining energy that is not coupled through the slots will reach the circumference of the disc where it will be radiated into the oven cavity via the gap between the circumference (outer edge) of the disc and the adjacent cavity walls. In contrast to the aforesaid system operating according to the near field power theory, this feed system operates with a very distributed radiation. Due to the location of the antenna slots close to the periphery of the rotating disc, substantially all radiation takes place in the vicinity of the circumference of said disc so that none of the energy is absorbed directly by the food, but the energy instead excites the cavity. The rotating disc then serves as a variable slot antenna means, as a means for periodically varying the distribution of the energy coupled through the peripheral gap and as a mode stirrer for periodically varying the resonance conditions of the oven cavity.

The energy feed system for coupling energy from the microwave energy source to the interior of the oven cavity thus provides a large degree of freedom in selecting various parameters, notably the number, size and location of the slots in the disc, so as to achieve a nearly completely even energy distribution within the oven cavity which is practically independent of the size and location of the articles to be heated. Furthermore, the narrow space between the cavity wall containing the feeding aperture and the disc is utilized not only to propagate microwave energy to the radiating slots but also to guide the air stream for driving the disc, thereby considerably simplifying the disc drive mechanism.

In a preferred embodiment in which the feeding aperture is arranged in the bottom wall of the oven cavity, the disc is located in a closed compartment formed between the bottom wall and a plate which is permeable to microwave energy and serves as a supporting shelf for the articles to be heated. This will improve the guidance of the air stream past the disc. The air stream can then be derived simply from the cooling air in that apertures are provided in two opposite side walls of the oven cavity at a level below the plate to permit air to pass through the compartment. A very simple drive mechanism is then obtained in that the projections of the disc are shaped as radial vanes secured to the lower side of the disc and serve as guidance channels for the air stream.

To improve the smoothing of the energy distribution, the slots may be positioned at different radial distances from the centre of the disc and may have a circular arc-shape with an arc-length exceeding a quarter of a wavelength at the operation frequency.

If the disc is rotational symmetric, it will shown an appreciable unbalance with respect to its centre of rotation due to the eccentric journalling. To eliminate this drawback and to enable use of a simple bearing, the disc may further comprise recesses in the half of the disc having the longest distance between the circumference and the centre of rotation, which recesses are located and dimensioned so as to cause the center of gravity of the disc to coincide substantially with the center of rotation. Preferably, the recesses are in the shape of circle sectors, at least some sectors joining to radiating slots.

The invention will now be described in more detail, by way of non-limitative example, with reference to the accompanying drawings, in which.

Figure 1:
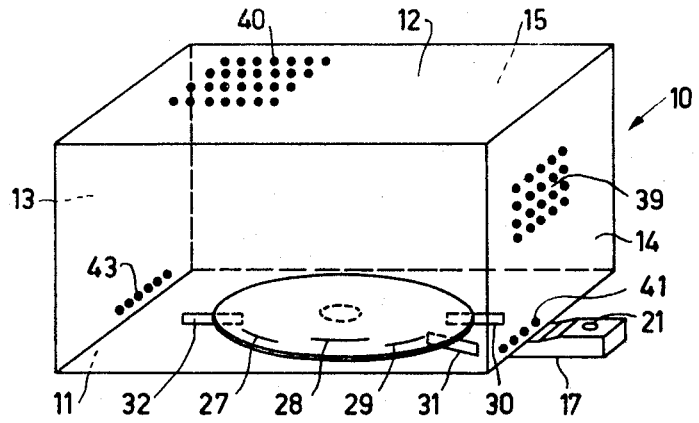
FIG. 1 shows a simplified perspective view of the oven cavity of a microwave oven according to the invention, but without a magnetron and other auxiliary apparatus and without a food supporting shelf.
Figure 2:
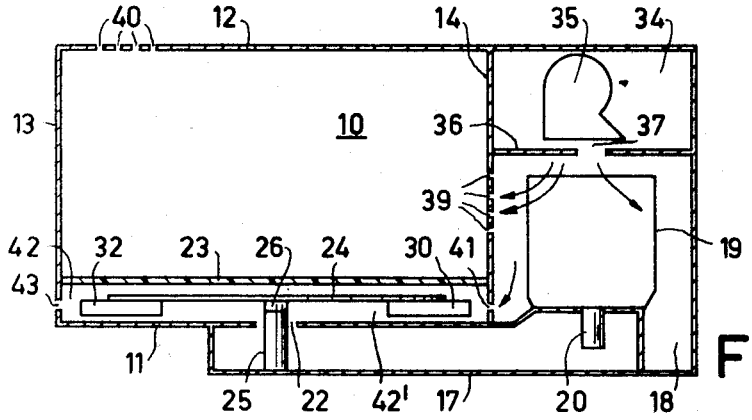
FIG. 2 shows a vertical sectional view through the same cavity with secondary spaces and auxiliary apparatus situated therein.
Figure 3:
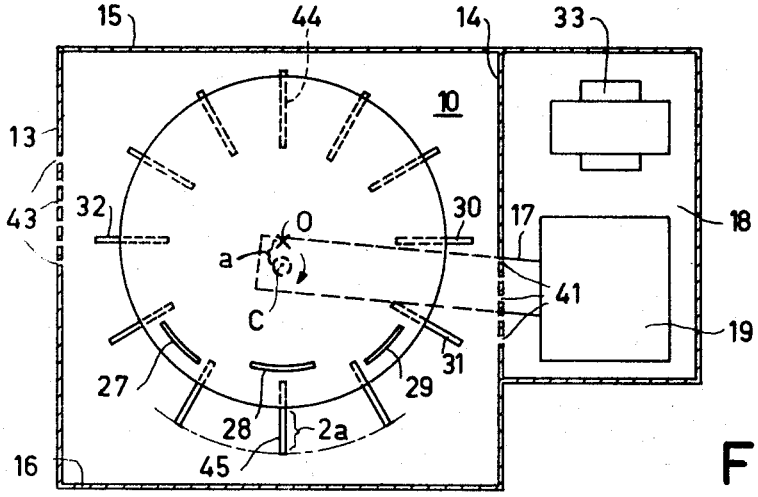
FIG. 3 shows a horizontal sectional view through the cavity and secondary spaces.

In FIG. 1 reference numeral 10 denotes a rectangular oven cavity which is limited by a bottom plate 11 and a top plate 12, two side walls 13 and 14, respectively, a rear wall 15 and a front wall 16. The front wall 16 has an opening, not shown, which provides access to the interior of the cavity 10 and can be closed by means of a door. As shown in greater detail in FIG. 2 a feeding waveguide 17 is arranged on the bottom side of the cavity 10. One end of the feeding waveguide 17 projects into a secondary space 18 situated beside the cavity 10 and which supports a magnetron 19, the antenna 20 of which projects into the waveguide 17 through an aperture 21 in the upper side of the waveguide. The opposite end of the waveguide 17 extends below the bottom plate 11 somewhat beyond the center of the cavity 10, where an aperture 22 is provided in the wall separating the cavity 10 and the waveguide 17. Within the cavity 10 there is a supporting shelf 23 of dielectric material. Below this shelf 23 there is a rotatably arranged antenna disc 24 supported by a supporting pin 25 of dielectric material. The supporting pin 25 is fixed and projects from the bottom of the waveguide 17 through the aperture 22 into the cavity. A bushing 26 of Teflon TM is secured to the lower side of the antenna disc 24, which bushing 26 bears against the upper end of the supporting pin 25 for forming a journal bearing for the disc 24, as will be described in detail with reference to FIG. 5. Close to the periphery of the disc 24 a number of slots are cut in the disc, of which some slots 27, 28, 29 are shown in FIG. 1 (and also in FIG. 3), and at the lower side of the disc there are a number of radial vanes distributed in a substantially uniform way around the circumference. For the sake of clearness only a few vanes 30, 31 and 32 are shown in FIGS. 1 and 2, while the position of all vanes is evident from FIG. 3. FIG. 3 also shows that the secondary space 18 also contains a transformer 33 besides the magnetron 19, while FIG. 2 shows that above the space 18 a further secondary space 34 is provided which includes a fan 35. These secondary spaces 18 and 34 are separated by a wall 36 provided with an aperture 37 forming an entrance opening to the space 18 for the cooling air provides by the fan 35. A large number of small apertures 39 are provided in the cavity side wall 14 substantially opposite the magnetron 19, through which apertures 39 the cooling air can flow from the space 18 into the cavity 10. Exit apertures 40 for the cooling air are for instance provided in the top plate 12 of the cavity 10. Furthermore, a row of small apertures 41 is provided at the bottom part of the cavity side wall 14. The apertures 41 connect the space 18 with a space 42 between the supporting shelf 23 and the bottom plate 11 of the cavity. Approximately diametrically opposite the apertures 41 there is a similar row of apertures 43 provided at the bottom part of the cavity side wall 13. The apertures 41 form entrance opening for an air stream from the space 18 into the space 42, while the apertures 43 form exit openings for this air stream. The supporting shelf 23 is secured hermetically to the cavity walls so that the space 42 below the supporting shelf 23 is a closed space except for the entrance and exit openings 41, 43. The secondary space 18 containing the magnetron 19 and the transformer 33 is also a closed space except for the entrance and exit openings 37 and 39, 41.

The circular disc 24 is journalled eccentrically, as is evident from FIG. 3, where the center of the disc is denoted by O and the center of rotation is denoted by C. The center of rotation C coincides approximately with the center of the bottom plate 11 of the cavity and with the center of the feeding aperture 22. When the disc 24 is rotating it will perform a translational motion in its own plane with a maximum stroke length $2a$, where a is the distance between O and C, as indicated in FIG. 3. The radial vanes on the lower side of the disc 24 are then arranged so that they all have the same distance to the center of rotation C. The individual vanes will thus project over different distances from the outer circumference of the disc 24, as is also evident from FIG. 3, where the vane 44 located closest to the center O of the disc has its outer end in line with the circumference of the disc, while the diametrically opposite vane 45 projects maximally over a distance approximately equal to $2a$ from the circumference. As a result, all vanes will move along substantially the same path relative to the cavity wall. The row of apertures 41 providing air entrance for the space 42 under the supporting shelf 23 extends approximately from the center of the cavity wall 14 in a direction towards the front wall 16 while the row of apertures 43 providing air exit extends approximately from the center of the cavity wall 13 in a direction towards the rear wall 15. The air stream through the space 42 will thereby be guided in an oblique path passing close to, but to one side of the center of the disc.

Figure 4:
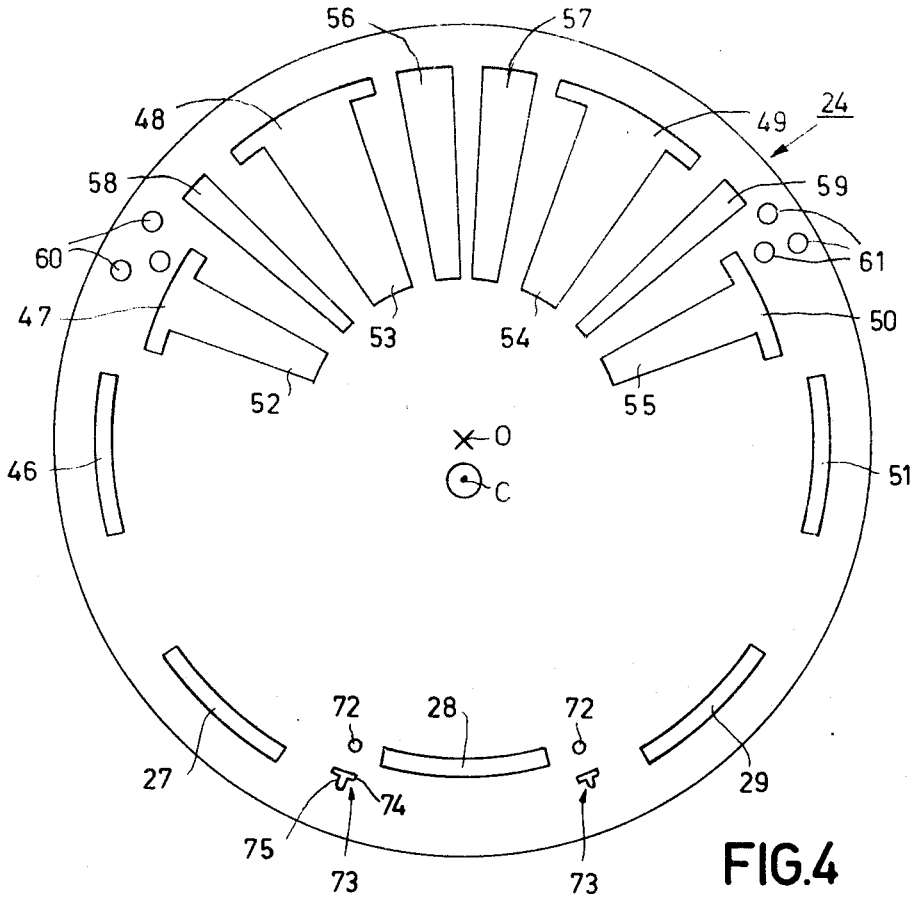
FIG. 4 shows a plan view in enlarged scale of a rotatable disc forming part of the energy feeding system of the microwave oven.

FIG. 4 shows a detailed view of the rotatably journalled disc 24 in one embodiment. In this example there are in addition to the already mentioned slots 27, 28, 29, six further slots 46, 47, 48, 49, 50, 51 cut in the disc close to its circumference. The slots 27, 28, 29 form a first group with the middle slot 28 lying closer to the center O of the disc 24 and the surrounding slots 27, 29 lying closer to the circumference, while the slots 46, 47, 48 form a similar second group with the middle slot 47 lying closer to the center and the slots 49, 50, 51 form a similar third group with the middle slot 50 closest to the center. The slots have a length which is larger than $\lambda/4$, where $\lambda$ is the wavelength corresponding to the operation frequency. In the example given those slots which are located closest to the center are somewhat shorter than the slots lying beyond said slots. The slots serve as antenna elements and the length of the slots is adapted to the quantity of energy which the respective slots are to transmit. In order to achieve balancing of the disc 24 with respect to its center of rotation C the slots 47, 48, 49, 50 which are located on that half of the disc which has the greatest distance to the center of rotation C extend into radial sector-shaped recesses 52, 53, 54, 55. Between the slots 48, 49 there are two further sector-shaped recesses 56, 57 and between the slots 47, 48 and 49, 50, respectively, there are sector-shaped recesses 58 and 59, respectively. The radially arranged sector-shaped recesses will not contribute to the transmission of energy through the disc 24. It has also been proved that an antenna element, for example 47 or 48, which extends into such a sector-shaped radial recess will transmit substantially the same energy as a similar antenna element, for example 28 or 27, which does not extend into such a radial recess. This can be explained in that current concentration will arise at those places where such radial recesses are present so that the resulting current in each radial direction will be practically the same, whether or not there are radial recesses. For the final balancing there are, in the example given, two groups of small circular apertures 60 and 61, respectively. The radial recesses 52–59 and the aperture groups 60, 61 are so dimensioned and located that their combination will given an exact balancing of the disc 24 with respect to its center of rotation C.

Figure 5:
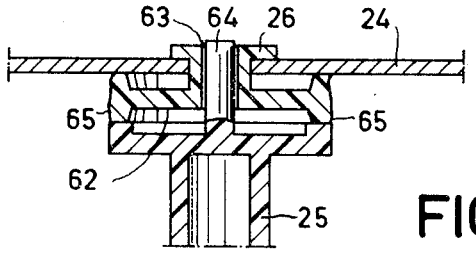
FIG. 5 shows a partial sectional view through the central part of the disc and the supporting pin for illustrating the journalling of the disc.

The exact balancing of the disc 24 enables use of a very simple journal bearing. An example of such a journal bearing is shown in FIG. 5. It comprises the previously mentioned bushing 26 of Teflon TM, which is secured to the lower side of the disc 24 concentrically with the desired center of rotation C. The bushing 26 has a central recessed portion 62 at its lower side and a central circular aperture 63. The supporting pin 25 cooperates with the bushing 26 and has at its upper end a projecting pin 64 which, at mounting, is introduced into the aperture 63 in the bushing 26. An annular end surface 65 of the bushing 26 located outside the recessed portion 62 then will bear against a corresponding annular shaped portion of the end surface of the supporting pin 25. The bearing is thus formed by the two cooperating end surfaces of the bushing 26 and the supporting pin 25 in combination with the centering pin 64 which is introduced into the aperture 63. As a result of the exact balancing of the disc 24 there is no need for additional measures in order to prevent tilting of the disc.

Figure 6:
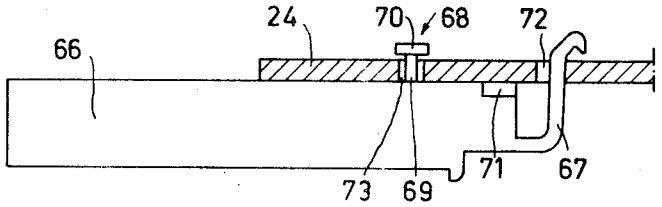
FIG. 6 shows a sectional view through a peripheral part of the disc for illustrating the fastening of the vanes used for driving the disc.

FIG. 6 shows a simple embodiment of a vane used for driving the disc 24 and its mounting in the disc. According to FIG. 6 the vane consists of an elongate blade 66 of dielectric material which at one end continues in a resilient hook shaped part 67. On its upper side the blade 66 has a projecting knob 68 consisting of a thin neck 69 and a head 70. For stabilizing the wing it has, preferably at the end near the elastic hook 67, two transversally projecting plates of which one plate 71 is visible in the drawing. At the place where a vane is to be secured to the disc 24, the disc is provided with two fastening apertures 72, 73, the inner aperture 72 being substantially circular and adapted to the hook 67, the outer aperture 73 consisting of a widened portion 74 and an outwardly tapering portion 75. At mounting of the vane the hook 67 is introduced from below into the aperture 72 until the hook grips behind the upper side of the disc 24. The vane is thereafter pressed radially inwardly under bending of the elastic hook 67 and the head 70 is introduced from below into the widened portion of the aperture 73. When the vane is then left free, the elastic hook 67 will reassume its original form by resilience so that the thin neck 69 of the knob 68 is pressed into the tapered portion of the aperture 73. After mounting, the plate shaped projections 71 will bear against the lower side of the disc 24 and give the vane stability.

The arrangement operates as follows:

When the microwave oven is connected to its operation voltage, the fan 35 starts and will produce over-pressure in the closed space 18. A main air stream is produced in the space 18, which stream sweeps past the transformer 33 and the magnetron 19. A large portion of the air stream is then pressed through the apertures 39 into the cavity 10 and will leave the cavity via the apertures 40. This portion of the air stream is substantially responsible for the cooling of the transformer 33 and the magnetron 19 and for the venting of the cavity space. Due to the over-pressure within the closed space 18, a small portion of the air stream, about 10% of the main air stream, is also pressed through the apertures 41 into the closed space 42 below the supporting shelf 23. This air stream then passes transversely through the space 42 and leaves through the apertures 43. The relative position of the apertures 41 and 43 is such that this air stream is led in a path extending substantially in a radial direction with respect to the disc 24 and passes close to, but to one side of the center of the disc. Due to its asymmetric path the air stream will produce a force on a number of vanes resulting in a torque in one and the same direction relative to the center of rotation. As a result of the force on the vanes below the disc 24 this disc will start to rotate and will continue to rotate with a substantially constant, relatively low speed in the direction indicated by the arrow, as long as the fan 35 is operative.

When the magnetron is switched-on, continuously or intermittently, energy is fed via the antenna 20 through the feeding waveguide 17 and through the feeding aperture 22 into the narrow space 42' between the disc 24 and the bottom plate 11 until it reaches the slots 27–29, 46–51. Each such slot is excited so that it will serve as an antenna element radiating energy into the cavity. Due to the rotation of the disc and its translational motion caused by the eccentric journalling, each radiating antenna slot will vary its position within the cavity continuously, whereby the radiation pattern within the cavity will be varied continuously. That part of the energy which is not transmitted through the antenna slots will propagate radially outwardly to the outer circumference of the disc 24, where the remaining energy will appear as free radiation and excite the oven cavity 10. This excitation produces a standing wave pattern within the cavity 10. Due to the continuously varying position of the disc as a result of both its rotation and its translation, this standing wave pattern will continuously be imparted a variation in time. The combination of both these effects, i.e. the direct radiation by variably located antenna elements and the variable excitation of the oven cavity, results in a very even heating of food placed on the supporting shelf 23, irrespective of the size, location and distribution of the food.

Within the scope of the invention the disc 24 may also be provided with slots lying closer to the center of the disc and, if desired, distributed over the whole area of the disc.

What is claimed is:

1. A microwave oven comprising an oven cavity bounded by a plurality of conductive walls, a microwave energy source mounted external of said oven cavity, and an energy feed system for coupling energy from the microwave energy source to the interior of the oven cavity comprising, an energy feeding aperture in one cavity wall, a waveguide external to said oven cavity coupling the microwave energy source to said energy feeding aperture, and a rotatable slotted disc arranged within the oven cavity in front of the feeding aperture for producing a relatively uniform energy distribution within the oven cavity, and wherein the disc is dimensioned so as to cover most of said one cavity wall and is arranged at a small distance from the one cavity wall so that a narrow space is formed between said one cavity wall and the disc, said narrow space serving to propagate microwave energy radially from the feeding aperture, the disc comprises a plurality of slots oriented transversally to their respective radial position vectors and dimensioned so as to be excited by microwave energy propagating in said narrow space thereby to radiate energy into the interior of the oven cavity, the disc is journalled eccentrically so that both the disc and the slots perform simultaneously a rotation and a translation as the disc is rotated; and means for rotating the disc in a predetermined direction.

2. A microwave oven as claimed in claim 1, wherein the feeding aperture is arranged in the bottom wall of the oven cavity, said oven further comprising a plate permeable to microwave energy and located within the oven cavity to form a closed compartment between the bottom wall and the plate, said plate serving as a supporting shelf for articles to be heated, and wherein said disc rotating means comprises means for passing an air stream through said narrow space via apertures provided in two opposite side walls of the oven cavity at a level below the plate so as to permit air to pass through the compartment and to impinge upon projections of the disc.

3. A microwave oven as claimed in claim 2, wherein the projections are shaped as radial vanes secured to the lower side of the disc and serve as guidance channels for the air stream.

4. A microwave oven as claimed in claim 1, wherein the slots are positioned at different radial distances from the center of the disc.

5. A microwave oven as claimed in claim 1, wherein the slots are circular arc-shaped and have an arc-length exceeding a quarter of a wavelength at the operation frequency of the energy source.

6. A microwave oven as claimed in claim 5 wherein the disc is circular, characterized in that the disc further comprises recesses formed in the half of the disc having the longest distance between the circumference and the center of rotation, said recesses being located and dimensioned so as to cause the center of gravity of the disc to coincide substantially with the center of rotation.

7. A microwave oven as claimed in claim 6, wherein the recesses are in the shape of circle sectors, at least some sectors being joined to radiating slots.

8. A microwave oven as claimed in claim 1 wherein said microwave energy source comprises a magnetron having an output probe spaced apart from the energy feeding aperture so that the disc is rotated about an axis spaced apart from the axis of the magnetron output probe.

9. A microwave oven comprising an oven cavity limited by a plurality of conductive walls, a microwave energy source, and an energy feed system for coupling energy from the microwave energy source to the interior of the oven cavity comprising a centrally located feeding aperture in one of said cavity walls and a rotatable slotted disc arranged within the oven cavity in front of the feeding aperture for producing an even energy distribution within the oven cavity, the disc being arranged so as to form an energy coupling gap between the outer edge of the disc and adjacent walls of the oven cavity, the disc being located a small distance from said one wall so that a narrow space is formed between said one cavity wall and the disc, said narrow space allowing microwave energy to propagate radially in all directions about the central feeding aperture, the disc including a plurality of slots arranged close to the periphery of the disc and oriented transversely to their respective radial vectors for coupling energy from said narrow space into the interior of the oven cavity, the disc being journalled eccentrically to function as a variable slot antenna means, as a mode stirrer and as a means for periodically varying the width of said energy coupling gap whereby energy from said narrow space also is radiated through said energy coupling gap into the oven cavity, and means for rotating the disc.

10. A microwave oven as claimed in claim 9 wherein the microwave energy source is positioned external to the oven cavity and said energy feed system further comprises a waveguide coupling the microwave energy source to said feeding aperture, and wherein said slots are arranged in at least two symmetrical groups of slots with at least one slot of each group positioned at a different radial distance from the center of the disc than at least one other slot in its respective group.

11. A microwave oven as claimed in claim 9 wherein at least some of the slots are circular arc-shaped with an arc length of at least $\lambda/4$ where $\lambda$ is the wavelength of the microwave energy supplied by the energy source.

12. A microwave oven as claimed in claim 11 wherein said disc further comprises a plurality of generally radially extending recesses dimensioned so as not to radiate microwave energy into the oven cavity.

13. A microwave oven comprising a plurality of conductive walls that define a generally rectangular oven cavity and with an energy feed aperture centrally located in one cavity wall, a microwave energy source located external to said oven cavity and coupled to said energy feed aperture, a rotatable disc having a plurality of antenna slots therein and arranged within the oven cavity adjacent the energy feed aperture to form a narrow space between said one cavity wall and the disc for propagating microwave energy radially in all directions about the energy feed aperture and toward cavity walls bounding said one cavity wall, the periphery of said disc being spaced from said bounding cavity walls to form therewith a circumferential energy coupling gap for energy propagating in said narrow space, said slots in the disc being symmetrically located about and close to the periphery of the disc and oriented transversely to respective radial vectors so as to couple microwave energy propagating in the narrow space into the oven cavity, and means for eccentrically rotating the disc about the energy feed aperture so that the disc and the antenna slots simultaneously rotate and perform a translational motion in the plane of the disc whereby each antenna slot periodically varies its distance from the feed aperture thereby to periodically vary the radiation pattern within the oven cavity, the width of said circumferential energy coupling gap also varying periodically as the disc rotates so as to periodically vary the radiation pattern within the oven cavity due to microwave energy coupled from said narrow space to the oven cavity via said circumferential energy coupling gap, and wherein the rotatable disc further functions as a mode stirrer to periodically vary the radiation patterns within the oven cavity.

14. A microwave oven comprising a plurality of conductive walls that define an oven cavity and with an energy feed aperture located in one cavity wall, means for coupling said energy feed aperture to a source of microwave energy located external to the oven cavity, and an energy feed system for coupling energy from said feed aperture into the oven cavity comprising, a rotatable conductive disc arranged within the oven cavity parallel to said one cavity wall and adjacent the energy feed aperture to form a narrow space between said one cavity wall and the disc for propagating microwave energy radially about the energy feed aperture, said disc including a plurality of energy radiating slots arranged close to the periphery of the disc so as to couple microwave energy propagating in the narrow space into the oven cavity, the periphery of said disc being closely spaced to walls of said cavity bounding said one cavity wall to form therewith a peripheral energy coupling gap so as to couple microwave energy propagating in the narrow space into the oven cavity, and means for rotating the disc about the energy feed aperture so that the radial distance of the slots from the energy feed aperture varies periodically and the width of the peripheral energy coupling gap also varies periodically whereby substantially all of the microwave energy radiates into the oven cavity in the vicinity of the periphery of the disc to produce an evenly distributed energy radiation pattern within the oven cavity that varies with the rotation of the disc.

15. A microwave oven as claimed in claim 14 wherein said rotating means includes means for directing a stream of air through said narrow space and toward said disc, said oven further comprising a plate permeable to microwave energy and located within said oven cavity to form a closed compartment between said one cavity wall and the plate thereby to enclose said rotatable disc.

* * * * *